United States Patent [19]

Kimblin et al.

[11] 4,215,255

[45] Jul. 29, 1980

[54] VACUUM ARC SWITCHING DEVICE WITH INTERNAL SHIELDING

[75] Inventors: Clive W. Kimblin; Joachim V. R. Heberlein; Paul G. Slade, all of Pittsburgh; Roy E. Voshall, New Alexandria; Francis A. Holmes, Monroeville, all of Pa.

[73] Assignee: Electric Power Research Institute, Inc., Palo Alto, Calif.

[21] Appl. No.: 867,103

[22] Filed: Jan. 5, 1978

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,431,226 | 11/1947 | Berkey et al. | 200/144 B |
| 3,026,394 | 3/1962 | Jennings | 200/144 B |
| 3,087,034 | 4/1963 | Beers et al. | 200/144 B |
| 3,953,693 | 4/1976 | Pflanz | 200/144 B |

*Primary Examiner*—Robert S. Macon

*Attorney, Agent, or Firm*—Flehr, Hohbach, Test, Albritton & Herbert

[57] ABSTRACT

A vacuum arc current switching device employs a shielding arrangement including a plurality of coaxially disposed cylindrical non-conducting members for minimizing exposure of the interior wall surfaces of the enclosure to vapor deposition of cathode material so as to prevent the formation of secondary arc terminals on the interior surfaces of the enclosure. The shielding being non-conducting prevents secondary arc formation which would otherwise permit arcing from the cathode to the shield and then back to the anode. The shielding further comprises annular transverse members disposed at the ends of the enclosure so as to protect the end wall surfaces as well.

3 Claims, 5 Drawing Figures

FIG_1
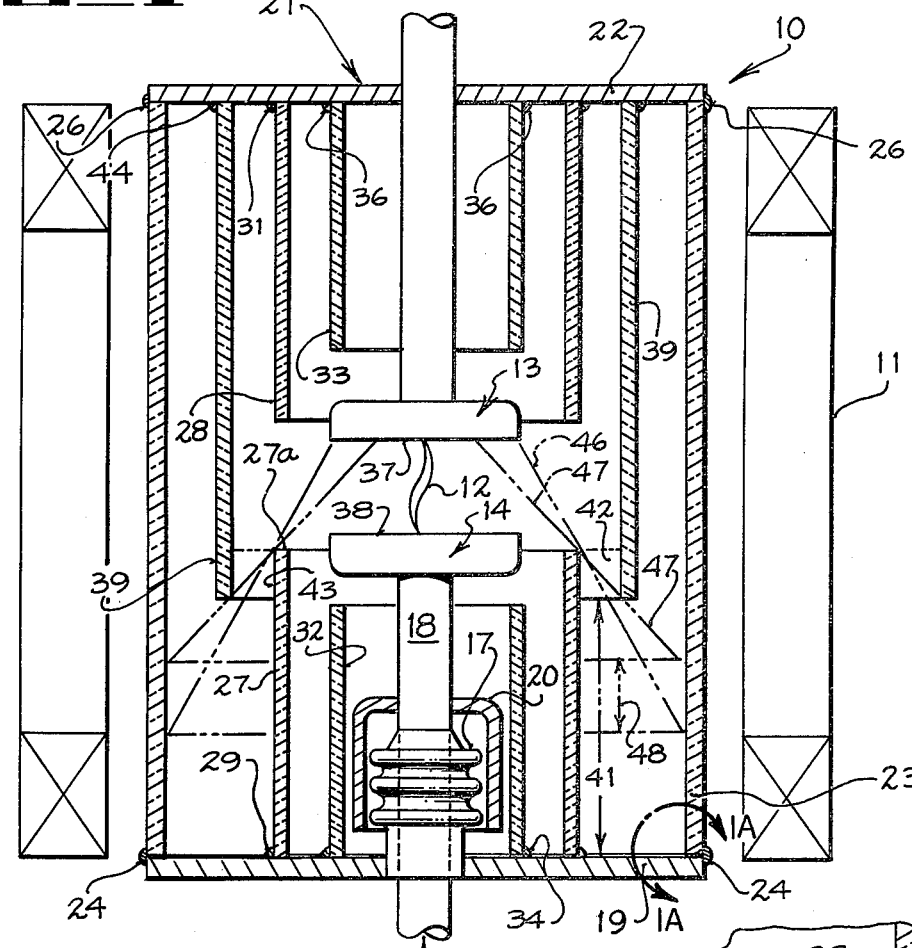
FIG_4
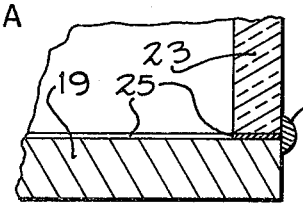
FIG_1A
FIG_2
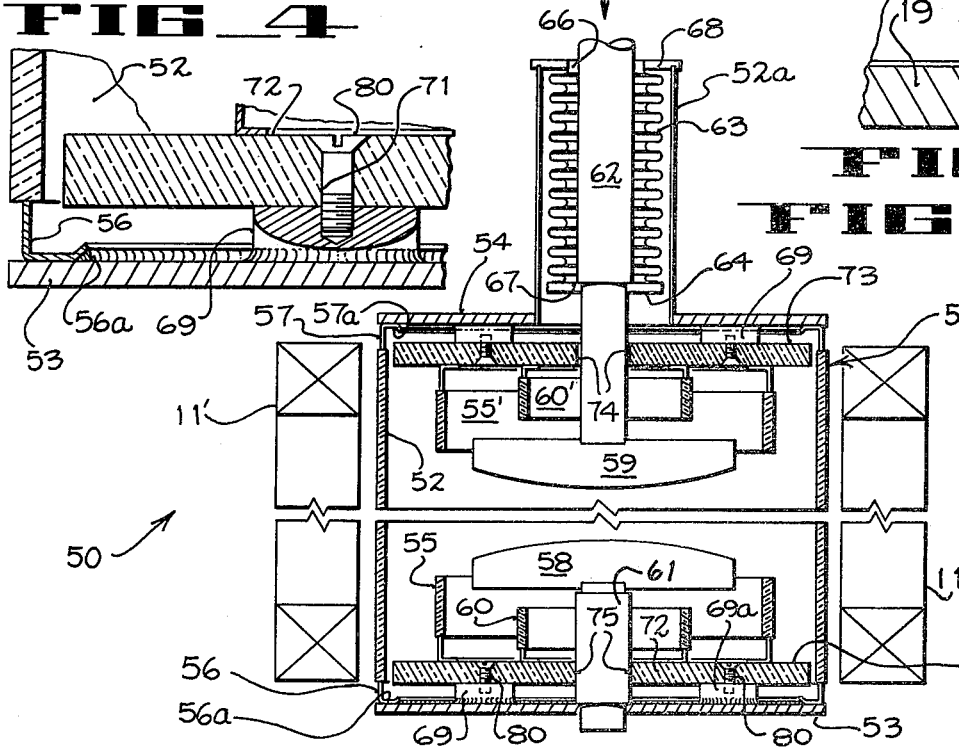

VACUUM ARC SWITCHING DEVICE WITH INTERNAL SHIELDING

BACKGROUND OF THE INVENTION

This invention pertains to vacuum arc switching devices and more particularly to such devices employing shielding for protecting the interior surfaces of the device from arc radiation.

In devices of the kind described high arc voltages have been obtained. By disposing an impedance in parallel across these devices it is possible to limit the fault current in high-voltage AC circuits. The arc voltage has been increased to high levels by application of an externally applied magnetic field transverse to the electrode gap. Nevertheless, other problems still exist. For example, after the arc is swept from the inter-electrode region under the influence of the magnetic field the discharge seems to continue along the ceramic wall of the vacuum enclosure with subsequent transfer to the electrode stems and/or to the metal end plates thereby coating the side walls, electrode stems and end plates with electrode material. Such coating causes rapid degradation of the device. It is therefore important to prevent such coating of the vacuum device with electrode material. This will not only prevent arc transfer but will also stop the rapid degradation of the device that occurs once the arc has burned along the ceramic wall.

SUMMARY OF THE INVENTION AND OBJECTS

In general, a vacuum arc current switching device of a type having a sealed enclosure of insulating material employs a first electrode carried by one end of the enclosure and a second electrode carried from the other end of the enclosure disposed to move between closed and spaced arc current transfer relation with respect to the first electrode. In the closed position the electrodes carry a continuous circuit current. These electrodes are separated during the fault current rise and a vacuum arc is established between the separating electrodes. The enclosure and electrodes are adapted to be disposed within a transverse magnetic field for modulating the arc voltage between the electrodes. Means carried from the ends of the enclosure serve to shield a sufficiently extensive portion of side and end wall surfaces of the interior of the enclosure from receiving a vacuum deposited layer of electrode material so as to maintain an electrical gap on such surfaces at least substantially as great as the displacement defined between the electrodes at their maximum spaced relation. This formation of a gap in the vacuum deposited conductive material on the interior of the enclosure inhibits arc transfer from the electrode region due to development of secondary arc terminals on surfaces within the enclosure where there has been vapor deposition of a conductive layer. Further, the internal surface of the ceramic envelope must withstand the dielectric recovery voltage following arc current extinction.

In general, it is an object of the present invention to provide an improved vacuum arc switching device with shielding means therein serving to inhibit arcing along the surfaces of the envelope from end plate to end plate.

It is another object of the present invention to provide axially elongate and radially transverse means in an arc current switching device which serves to protect vulnerable parts of the envelope from exposure to the arc plasma such as along brazing seams and the like.

It is yet another object of the present invention to provide axially elongate and radially transverse shielding means for accomplishing the foregoing purposes in a manner avoiding arcing between adjacent shielding means.

The foregoing and other objects of the invention will become more clearly apparent from the following detailed description of preferred embodiments when considered in conjunction with the drawings.

BRIEF DESCRIPTION OF THE DRAWINGS

FIG. 1 shows a diagrammatic side elevation section view of a vacuum arc current switching device according to the invention;

FIG. 1A shows an enlarged diagrammatic section view, taken along the line A—A of FIG. 1;

FIG. 2 shows a diagrammatic side elevation section view of a vacuum arc current switching device according to another embodiment of the invention;

FIG. 4 shows an enlarged elevation section detail of a portion of FIG. 2, according to the invention.

DETAILED DESCRIPTION OF PREFERRED EMBODIMENTS

Figure 3:
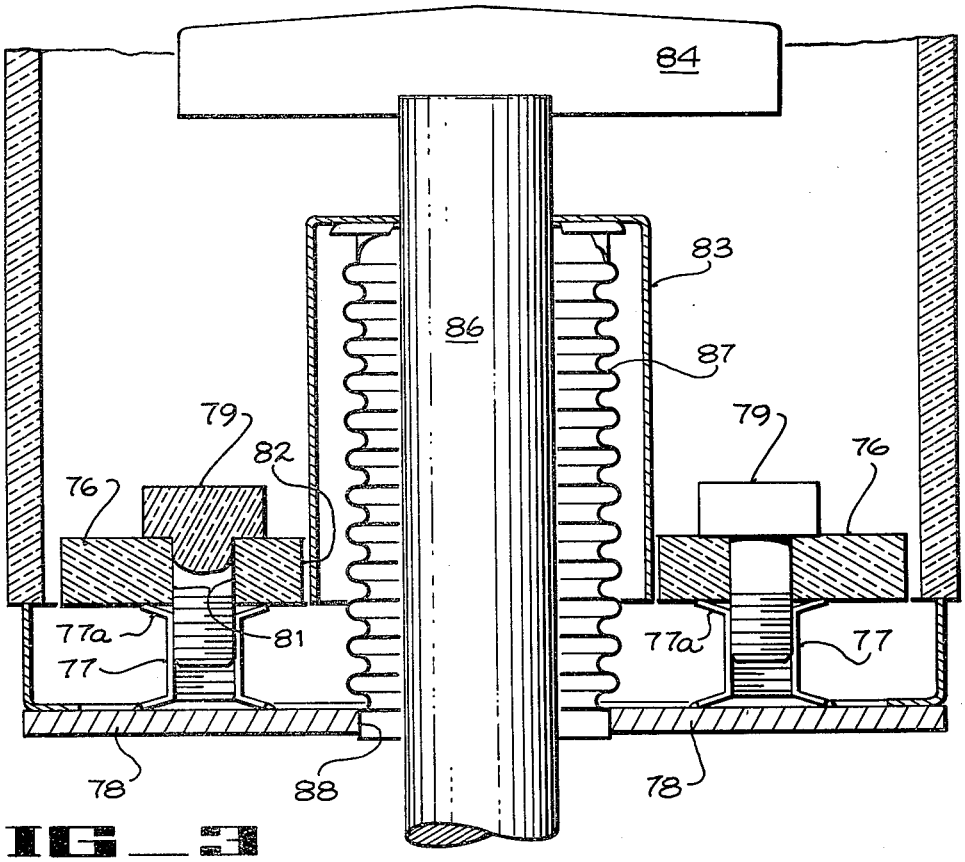
FIG. 3 shows a diagrammatic side elevation section view of another embodiment of the end disc mounting means shown in FIG. 2.

A vacuum arc current switching assembly 10 is shown with its axis perpendicular to the axis of the field of magnetic coils 11 for electromagnetically causing instability in the arc 12 which is formed between stationary and movable electrodes, 13, 14 respectively.

Electrode 14 is disposed for movement between advanced and retracted positions by suitable known means diagrammatically represented by the double-ended arrow 16 whereby the spacing between electrodes 13, 14 can be rapidly increased so as to quickly interrupt arc current between the two electrodes. This action forms a metal vapor arc. A flexible substantially impervious seal 17 is secured at its upper end to a mounting rod 18 of electrode 14 and at its lower end secured to the edge of an opening in a bottom plate 19 of a sealed enclosure 21.

A protective shield 20 is carried by mounting rod 18 to move between advanced and retracted positions with the movements of rod 18 and in protective relation to seal 17 as well as the underlying top surface of bottom closure plate 19.

Enclosure 21 comprises the generally circular bottom plate 19 and top plate 22 of conductive material such as stainless steel. Plates 19, 22 serve to close the open ends of a ceramic cylinder 23.

Plates 19, 22 are secured to the ends of cylinder 23 by means of external brazing seams 24, 26. As shown in FIG. 1, and particularly in FIG. 1A, brazing seams 24, 26 are applied across an interface of molymanganese 25 laid down on the end surfaces of cylinder 23 so as to permit the brazing seam to be formed. According to another embodiment described below with respect to FIG. 2, Kovar is used to join the ceramic and steel.

Shielding means protect extensive portions of the interior side and end wall surfaces of enclosure 21 to maintain an electrical gap along such surfaces at least substantially as great as the maximum electrode separation so as to inhibit development of secondary arc terminals. Such shielding means comprises elongate cylinders 27, 28 of insulating material such as ceramic disposed coaxially of and spaced from each of the electrodes 13, 14.

For improved shielding a plurality of the elongate cylinders 32, 27, 33, 28 of ceramic insulating material is carried from each end plate 19, 22. Cylinders 32, 33 are also attached to their respective stainless steel end plates by similar brazing seams, 34, 36 or by Kovar flange connections as noted below.

From inspection of FIG. 1 it will be readily evident that each of the cylinders in each plurality (32, 27 and 33, 28 ) extends axially to a different degree relative to the disposition of their associated electrode. The axial extent of shields 32, 33 is determined by the spacing between contact surface 37 and end plate 22 and between contact surface 38 and end plate 19 when in the maximum open position of electrodes 13, 14.

Shield 27 serves to place the moly-manganese interface 25 in a protected position with respect to arc radiation or other vapor deposition of cathode material thereon as might tend to develop a secondary arc terminal.

The importance of protecting the interface 25 and associated brazing seam is to prevent the formation of a path defined from the arc to the region of the brazing seam (which is inherently vulnerable) and then to the other electrode so that the arc will be directed to travel a path transversely of the flux lines.

Finally, an additional shield in the form of a ceramic cylinder 39 protects a sufficient portion of wall 23 of enclosure 21 that could otherwise be exposed to arc plasma so as to inhibit formation of secondary arc terminals from developing from a vapor deposited layer of conductive material. A gap 41 of limited extent defined between the distal edge of cylinder 39 and end plate 19 is of sufficient extent to prevent the formation of an arc therebetween so as to preclude the formation of a conductive path from end plate to end plate.

However, by virtue of the fact that the end edge margins 42, 43 of shields 39, 27 respectively overlap, extensive areas of the interior end and wall surfaces of enclosure 21 are readily protected from arc radiation and from arcing products as might serve to coat the interior wall surfaces with a sufficient large area of vapor-deposited conductive material so as to form a secondary arc terminal whereby the back surfaces of the shields are coated by virtue of vapor deposition degenerated from such secondary arc terminals.

From the foregoing description it will be readily evident that the radially outer (i.e. the "back") side of the cylindrical shields remain protected from any direct radiation from the region defined between contact surfaces 37, 38. Accordingly, the development of secondary arc terminals will be inhibited by virtue of the fact that the cylindrical shields are of an insulating material which, even though they may become coated on one surface over a large extent they can not develop arc terminals on their back surfaces due to the intermediate insulation.

Thus, there has been provided an improved vacuum arc current switching device or interrupter in which elongate cylindrical ceramic shields are used to avoid arcing between shields. Arcing along the surface of the envelope from end plate to end plate is practically prevented because the interior wall surface of the envelope and the end plate surfaces are sufficiently shielded from arc radiation from the region of arc 12 by means of the concentric cylindrical shields. Thus, in order to sustain a discharge along any other surface, the arc is required to bridge a gap comparable to the electrode separation. The arc length is greatly increased by these obstacles leading to higher arc voltages and facilitating current commutation.

Further, the most vulnerable parts of the structure such as the brazing seams are shielded by the ceramic cylinders against exposure to arc plasma.

In assembling an apparatus of the kind described, the innermost cylindrical shield such as 32 or 33 is first secured to its associated end plate. This can be done by the brazing seams 34, 36. Next, brazing seams such as 29, 31 can be employed to secure cylinders 27, 28 to their associated end plates and in the case of end plate 22 (as shown in the drawing) the third cylindrical shield 39 is then secured by means of a brazing seam 44. Next, a one piece ceramic cylinder 23 is secured to end plate 19 by means of the brazing seam 24 whereby the enclosure can be formed by disposing end plate 22 and its associated cylindrical shielding and electrode 13 downwardly into the opening defined by the upper end of cylinder 23. End plate 22 is then sealed to cylinder 23 by means of the brazing seam 26 extending therearound.

Lines 46, 47 represent the straight line paths of ions from one of the electrodes 13 whereby the interior of cylinder 23 is exposed to the maximum extent. Accordingly, the band 48 around cylinder 23 may well constitute the only deposition of a conductive layer of material after a period of arc current operation. However, the extent of this band 48 of material is sufficiently small that arcing along the surface of envelope 23 from end plate to end plate is prevented.

Additional embodiments, according to the invention, are shown in FIGS. 2 and 3 characterized by means serving to inhibit arc transfer from the electrodes to the end surfaces of the sealed enclosure 51 of a vacuum arc current switching device 50. Referring to the embodiment in FIG. 2 sealed enclosure 51 comprises a cylindrical body 52 of insulating material such as ceramic or other rigid or semi-rigid material closed at each end by means of the end plates 53, 54, which can be of stainless steel or similar rigid material for purposes described further below. A cylindrically formed band 56, 57 of Kovar material connects the end edges of body 52 to end plates 53, 54 in conventional manner. Thus, the end edges of bands 56, 57 are turned inwardly to be sealed as by brazing to plates 53, 54 and the ceramic side wall 52. The inwardly turned edges **52*a* and 57*a* are readily brazed to their respective end plates 53, 54**.

As with most vacuum arc switching devices a stationary electrode 58 is provided in confronting relation with a movable electrode 59. A mounting post 61 serves to support electrode 58 and a movable mounting post 62 serves to carry electrode 59. Means forming a sealbetween mounting post 62 and end plate 54 includes the extensible bellows seal 63 of substantially impervious material coupled at one end to an attaching ring 64 carried on the shoulder 57 of post 62. The other end of bellows 63 is sealed to a closure plate 68 mounted on the end of the elongate envelope portion **52*a*. As thus arranged electrode 59 is disposed to be moved between advanced and retracted positions relative to electrode 58** in a sealed environment.

Means serving to protect end plates 53, 54 from receiving cathode material via the arc plasma established between electrodes 58, 59 comprises transversely extending protective insulating discs 72, 73 of suitable insulating material such as ceramic are disposed in spaced relation from their associated end plates 53, 54.

Discs 72, 73 extend radially outwardly to a position sufficiently close to inner side wall surfaces of cylindrical body 52 to prevent the transmission of arc plasma to the end plates. Similarly the central opening 75 of disc 72 provides a tight fit about support post 61 so as to inhibit passage of ions to the end plate 53 while opening 74 is only sufficiently spaced from support post 62 to permit the latter to move readily through the former while protecting end plate 54 from being struck by ions.

Means supporting ceramic discs 72, 73 comprises a plurality of stand-off elements 59 brazed to the inner surface of end plates 53, 54 formed with a threaded opening centrally thereof (not shown). Openings 71, through discs 72, 73 are beveled at their outer ends whereby a screw 80 can be disposed via opening 71 of stand-off 69. As thus arranged discs 72, 73 become firmly secured to the end walls of enclosure 51.

As shown in FIG. 2 protective discs 72, 73 serve to carry cylindrically shaped shields 55, 60 at one end of enclosure 51 and a similar pair of shields at the other end. Shields 55, 60 (and 55', 60') are supported from disc 72 (and 73) by means similar to the Kovar ring 56 employed in supporting the cylindrical body 52 from end plates 53, 54. Shields 55, 60 are of insulating material such as ceramic so as to intercept arc plasma deposits of cathode material.

It is evident that cylinders 55, 60 can be variously elongated as above described with respect to FIG. 1 and achieve similar purposes.

From the foregoing embodiment it will be evident that the annular ceramic discs 72, 73 effectively insulate the metallic end plates 53, 54 from plasma in the envelope. If the plasma, under the influence of the externally applied magnetic field moves towards the envelope, a transfer of the arc attachments from the contact electrodes to the end plates is made impossible by the ceramic disc. The current path under continued arcing conditions can then only be along a U-shaped trace from one electrode to the tube wall and back to the other electrode. This elongate path will require a significant increase in arcing voltage. Consequently, current commutation is obtained.

As shown in FIG. 3 according to another embodiment ceramic protective end discs 76 are supported in spaced relation with respect to the end walls 78 of the envelope by means of stand-offs 77 formed at their upper end with a broadly flanged portion such as 77*a*. Stand-offs 77 are brazed to the inner surface of an end plate 78 so that a ceramic bolt 78 passing through openings 81 can engage the threads formed within stand-off 77. Disc 76 is formed with a relatively wide central opening 82 for accommodating the passage therethrough of an inverted cup shaped shield 83 carried by the movable support post 86 carrying the movable electrode 84 mounted thereto. An expansible seal 87 extending between the opening 88 through end plate 78 and shield 83 at its upper end permits mounting post 86 and electrode 84 to move between advanced and retracted positions while maintaining a sealed environment within the envelope.

We claim:

1. In a vacuum arc current switching device of a type having means forming a sealed enclosure of insulating material for providing a vacuum environment, a first electrode carried from one end of said enclosure, a second electrode carried from the other end of said enclosure to be disposed in spaced arc current transfer relation therebetween, said enclosure and electrodes being adapted to be disposed within a magnetic field for modulating said arc current between said electrodes, a first plurality of elongate cylinders of insulating material carried by one end of said enclosure in coaxial relation to one of said electrodes, and a second plurality of elongate cylinders of insulating material carried by the other end of said enclosure and disposed coaxially of the other electrode, the cylinders of each of said pluralities extending axially to different degrees relative to the disposition of their associated electrode for shielding a sufficiently extensive portion of said side and end wall surfaces of the interior of said enclosure from vacuum deposition of electrode material to maintain an electrical gap at least substantially as great as the maximum electrode separation to inhibit development of secondary arc terminals on surfaces within said enclosure in response to vapor deposition thereon of a conductive layer of electrode material.

2. In a vacuum arc current switching device of a type having means forming a sealed enclosure of insulating material for providing a vacuum environment, a first electrode carried from one end of said enclosure, a second electrode carried from the other end of said enclosure to be disposed in spaced arc current transfer relation therebetween, said enclosure and electrodes being adapted to be disposed within a magnetic field for modulating said arc current between said electrodes, means extending axially of said enclosure for shielding a sufficiently extensive portion of said side and end wall surfaces of the interior of said enclosure from vacuum deposition of electrode material to maintain an electrical gap at least substantially as great as the maximum electrode separation to inhibit development of secondary arc terminals on surfaces within said enclosure in response to vapor deposition thereon of a conductive layer of electrode material, said shielding means including a first and second plurality of elongate cylinders of insulating material carried by and extending from each end wall of said enclosure respectively and disposed coaxially of and spaced from an associated one of said electrodes respectively, and seams disposed about the outer circumference of said enclosure and said cylinders for joining each of same directly to an end of the enclosure, said seams being protected by said shielding means from receiving vapor deposited conductive material sufficient to develop a secondary arc terminal.

3. In a vacuum arc current switching device of a type having means forming a sealed enclosure having side and end wall surfaces of insulating material for providing a vacuum environment, a first electrode carried from one end of said enclosure, a second electrode carried from the other end of said enclosure to be disposed in spaced arc current transfer relation therebetween, an annular disc member of insulating material carried from each of the end walls of said enclosure in spaced relation with respect thereto for inhibiting transmission of ions to the end walls, support elements carried to protrude inwardly from each end of said enclosure, fastening means retaining said annular disc members thereto to maintain said spaced relation, and support means extending through said annular means for carrying said electrodes, the radially inner and outer edges of said members being respectively disposed in sufficiently closely spaced relation with respect to said support means for an associated one of said electrodes and with respect to the inner side wall surface of said sealed enclosure so as to protect the end walls from receiving a conductive vapor deposit of electrode material in sufficient degree to cause an arc transferring thereto or therefrom, and a plurality of elongate cylinders of insulating material carried by and extending from each of said annular disc members for shielding a sufficiently extensive portion of the surfaces of said side walls and of said discs within the interior of said enclosure from vacuum deposition of electrode material to maintain an electrical gap at least substantially as great as the maximum electrode separation to inhibit development of secondary arc terminals on surfaces within said enclosure in response to vapor deposition thereon of a conductive layer of electrode material.

* * * * *